US008059064B2

(12) United States Patent
Itakura

(10) Patent No.: US 8,059,064 B2
(45) Date of Patent: Nov. 15, 2011

(54) METHOD OF DRIVING PLASMA DISPLAY PANEL

(75) Inventor: Shunsuke Itakura, Chuo (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 988 days.

(21) Appl. No.: 11/783,522

(22) Filed: Apr. 10, 2007

(65) Prior Publication Data

US 2007/0278958 A1 Dec. 6, 2007

(30) Foreign Application Priority Data

Jun. 6, 2006 (JP) ..... 2006-157502

(51) Int. Cl.
*G09G 3/10* (2006.01)

(52) U.S. Cl. ..... 345/67; 345/63; 345/208; 345/60; 313/584; 315/169.4

(58) Field of Classification Search ..... 345/60, 345/63, 67; 313/584; 315/169.4
See application file for complete search history.

(56) References Cited

U.S. PATENT DOCUMENTS

2002/0105278 A1* 8/2002 Kanazawa ..... 315/169.3
2005/0200571 A1* 9/2005 Gotoda et al. ..... 345/63

FOREIGN PATENT DOCUMENTS

| | | |
|---|---|---|
| JP | 2002-6803 | 1/2002 |
| JP | 2002-328648 | 11/2002 |
| JP | 3424587 | 5/2003 |
| JP | 2004-29185 | 1/2004 |
| JP | 2006-53564 | 2/2006 |
| KR | 2006-16929 | 2/2006 |

* cited by examiner

*Primary Examiner* — Lun-Yi Lao
*Assistant Examiner* — Olga Merkoulova
(74) *Attorney, Agent, or Firm* — Drinker Biddle & Reath LLP

(57) ABSTRACT

A method of driving a plasma display panel for avoiding an erroneous discharge. The plasma display panel has display cells formed at respective intersections of row electrode pairs and a column electrode, wherein one field of a video signal is comprised of a plurality of sub-fields, and a reset period is provided prior to an addressing period of a starting sub-field. The method has a light emission load state detection stage for detecting a light emission load state of the plasma display panel according to the video signal in the preceding field, and a first stage in the reset period for applying the first row electrodes with a pulse of a first polarity which has an applied voltage value increased over time to reach a predetermined target potential, wherein the first stage includes controlling the target potential of the first polarity pulse according to the light emission load state.

6 Claims, 11 Drawing Sheets

METHOD OF DRIVING PLASMA DISPLAY PANEL

BACKGROUND OF THE INVENTION

1. Field of the Invention

The present invention relates to a method of driving a plasma display panel which has display cells such as capacitive light emitting elements arranged in a matrix form.

2. Related Art

Japanese Patent No. 3424587 (Patent Document 1) discloses a known method of driving a plasma display panel. FIG. 1 shows driving waveforms disclosed in Patent Document 1. This figure shows the waveform at each of an address electrode and sustain discharge electrodes which include an X1 electrode, a Y1 electrode, an X2 electrode, and a Y2 electrode in an arbitrary sub-filed in one field for displaying an odd-numbered line. Each waveform includes a reset period, an addressing period, and a sustain discharge period. The following description will be given with reference to part of disclosed descriptions.

In the reset period, the address electrode is set to zero volt, followed by the application of a positive-polarity and a negative polarity pulse to the sustain discharge electrodes. Specifically, the X-electrodes are applied with a pulse having a voltage of −Vwx, while the Y-electrodes are applied with a pulse having a voltage of Vwy. In this event, the pulse applied to the Y-electrodes is a hang pulse which reaches the voltage Vwy while its voltage changing amount per unit time is changing. In this way, a first subtle discharge occurs between the X-electrodes and Y-electrodes. Since the use of the hang pulse causes each discharge cell to start a discharge at the time the applied voltages exceed a discharge start voltage Vf of each discharge cell, the resulting discharge is merely subtle, with a small amount of wall charges formed thereby. As a result, even if a reset discharge advances in a certain discharge cell, adjacent discharge cells are not affected thereby. Also, since the discharge is subtle, background light emission is also small.

Next, the X-electrodes are applied with a pulse having a voltage of Vex, while the Y-electrodes are applied with a pulse having a voltage of −Vey. In this event, the pulse applied to the Y-electrodes is a hang pulse which reaches the voltage −Vey while its voltage changing amount per unit time is changing. In this way, a second discharge occurs to erase the wall charge formed by the preceding discharge. Since a forced discharge occurs due to the application of a voltage Vex+Vey, an erasure discharge can be accomplished without fail.

Next, in the addressing period, a scanning pulse is sequentially applied to the Y-electrodes to perform an addressing discharge. Regarding the X-electrodes, a voltage Vx is applied to an X-electrode which is paired with a Y-electrode, which is applied with the scanning pulse, to constitute a displayed line, to perform the addressing discharge. On the other hand, a voltage of −Vux is applied to those X-electrodes which constitute non-displayed lines, with the intention to reduce a potential difference with the Y-electrodes to prevent the addressing discharge from occurring in the non-displayed lines.

Next, in the sustain discharge (sustain) period, a sustain pulse is applied alternately to the X-electrodes and Y-electrodes, causing sustain discharges to repeat in those cells in which the addressing discharge has been performed to display image data.

SUMMARY OF THE INVENTION

However, it has been found that a target voltage value of a pulse for adjusting the amount of wall charge in the reset period, like the pulse having the voltage Vex, varies in accordance with the number of light emission loads of a display panel such as a plasma display panel. Since such variations in wall charge amount cause variations in margin of selective discharges in THE addressing period, an erroneous charge is likely to occur at the time of the selective discharge in the subsequent addressing period.

A problem to be solved by the present invention is the foregoing problem by way of example. It is an object of the present invention to provide a method of driving a plasma display panel which avoids an erroneous discharge which can occur in the addressing period for the selective discharge.

A method of driving a plasma display panel according to the present invention is a method of driving a plasma display panel which has a plurality of row electrode pairs each comprised of a first row electrode and a second row electrode which form a pair, a plurality of column electrodes arranged across the row electrode pairs, and display cells formed at respective intersections of the row electrode pairs and the column electrode, wherein a display period for one field of a video signal is comprised of a plurality of sub-fields, and a reset period is provided prior to an addressing period of a starting sub-field in the display period for one field to make a display at multiple levels. The method has a light emission load state detection stage for detecting a light emission load state of the plasma display panel in accordance with the video signal in the preceding field, and a first stage in the reset period for applying the first row electrodes with a pulse of a first polarity which has an applied voltage value increased over time to reach a predetermined target potential, wherein the first stage includes a stage for controlling the target potential of the first polarity pulse in accordance with the light emission load state.

DETAILED DESCRIPTION OF THE INVENTION

Embodiments of the present invention will be described in detail with reference to the accompanying drawings.

Figure 1:
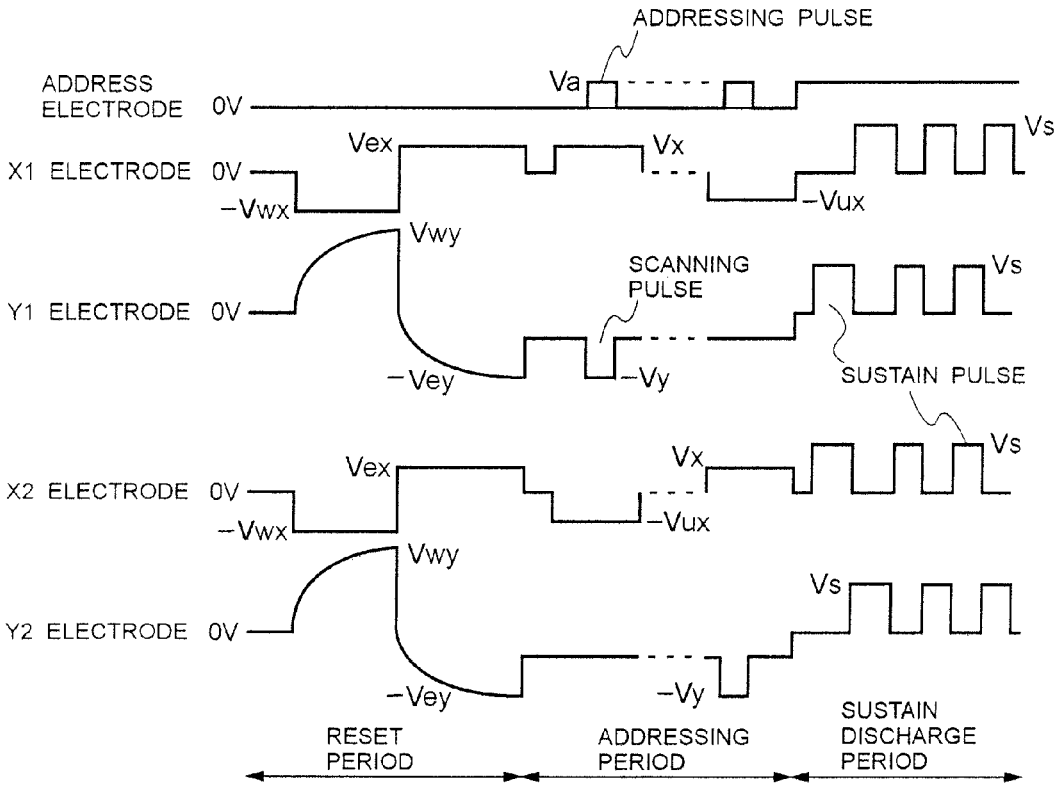
FIG. 1 PRIOR ART
FIG. 1 is a diagram showing waveforms in a reset period of a conventional display panel driving method.
Figure 2:
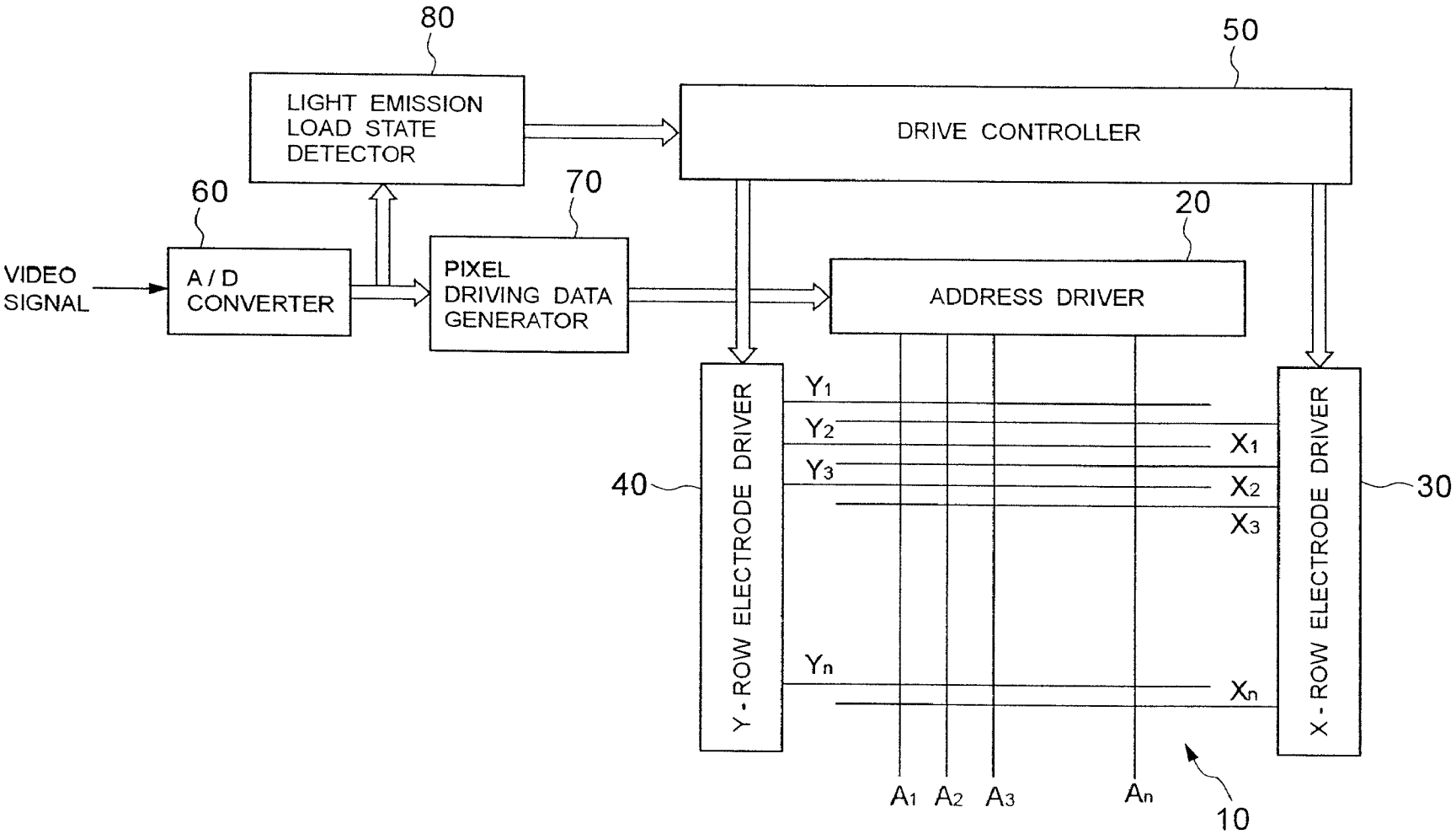
FIG. 2 is a diagram showing an exemplary configuration of a display panel which is an embodiment of the present invention, and to which a display panel driving method according to the present invention is applied.

FIG. 2 is a block diagram showing an embodiment of the present invention, showing an exemplary configuration of a display panel to which a display panel driving method according to the present invention is applied. Here, the display panel, i.e., a PDP 10 is formed with Y-row electrodes Y1-Yn which are first row electrodes and X-row electrodes X1-Xn which are second row electrodes, which define row electrode pairs corresponding to each displayed line (n rows) of one screen with pairs of X and Y, and column electrodes A1-Am corresponding to each column (m columns) of one screen orthogonal to the row electrode pairs and across a dielectric layer and a discharge space, and a display cell which is a capacitive light emitting elements is formed at the intersection of one pair of row electrodes (X-row electrode and Y-row electrode) with one column electrode D.

An A/D converter 60 samples an input video signal, converts the video signal to pixel data of, for example, eight bits, corresponding to each pixel, and supplies the pixel data to a light emission load state detector 80 and a pixel driving data generator 70. The pixel driving data generator 70 applies multi-level gradation processing to each data, and then converts the processed pixel data to pixel driving data which sets each display cell to either a light emitting discharge cell or non-light emitting discharge cell on a sub-field by sub-field basis to generate pixel driving data for one screen, and supplies the pixel driving data for one screen to an address driver 20 from one displayed line to another in an addressing stage Wc of a sub-field, later described. The address driver 20 converts the pixel driving data to pixel data pulses which are applied to the column electrodes A1-Am from one displayed line to another.

The light emission load state detector 80 senses a light emission load state of the plasma display panel from the pixel data supplied from the A/D converter 60, and supplies the light emission load state to the drive controller 50. For example, the number of cells which have sustain discharged in a sustain period for a field previous to a target starting sub-field is sensed as the light emission load state. Alternatively, the light emission load state may be sensed from a luminance histogram or an average luminance level.

The drive controller 50 generates a variety of timing signals for driving the PDP 10 at multiple levels in accordance with a light emission driving sequence from the pixel data supplied from the A/D converter 60, and supplies the timing signals to a Y-row electrode driver 40 and an X-row electrode driver 30. The drive controller 50 also adjusts a time length for which a wall charge adjusting pulse is applied in accordance with the light emission load state supplied from the light emission load state detector 80.

The X-row electrode driver 30 and Y-row electrode driver 40 generate a reset pulse and the wall charge adjusting pulses for initializing a remaining wall charge amount in each discharge cell in a reset period, and a sustain pulse for maintaining a discharge light emission state of light emitting discharge cells in a sustain discharge period, and correspondingly apply these pulses to each of the X-row electrodes X1-Xn and Y-row electrodes Y1-Yn. The Y-electrode driver 40 in turn generates a scanning pulse for causing each discharge cell to form the amount of charges in accordance with a pixel data pulse to set the discharge cell to a light emitting discharge cell or a non-light emitting discharge cell in an addressing period.

Figure 3:
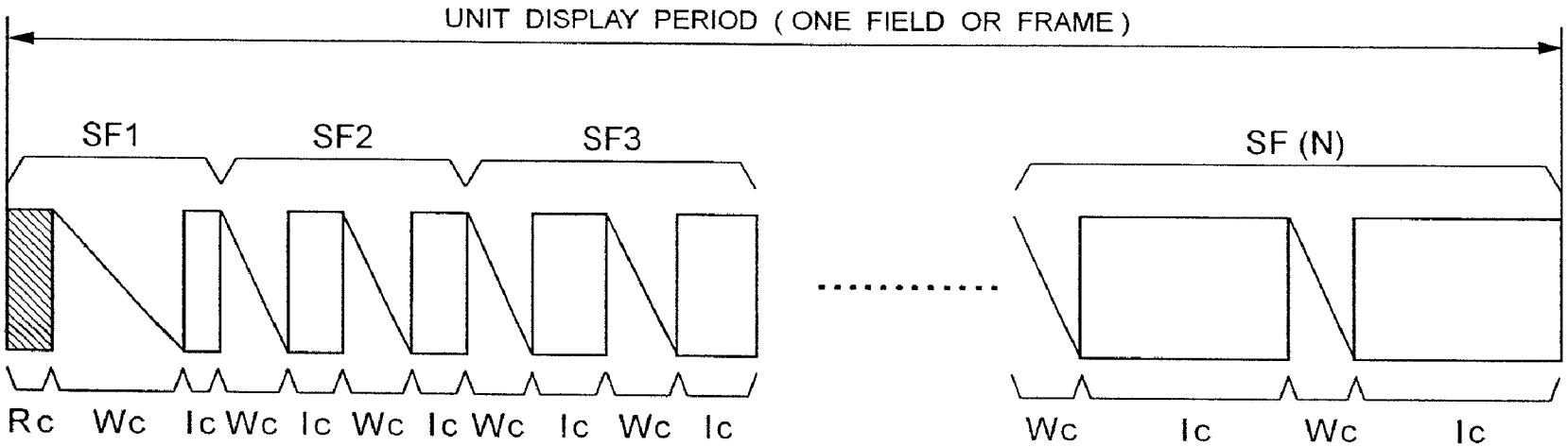
FIG. 3 is a diagram showing a sub-field arrangement in one field.

FIG. 3, shows a sub-field arrangement in one field. A video signal supplied to the PDP 10 constitutes one screen displayed by pixel data as one frame or field. As shown, one field of display period is comprised of a plurality of sub-fields SF1-SF(N) (N is a positive integer), where each of the sub-fields SF1-SF(N) includes an addressing period Wc and a sustain period Ic. A reset period Rc is provided prior to the addressing period Wc of the starting sub-field SF1 in one field of display period. The reset period Rc may also be provided prior to the addressing period Wc in at least one sub-field subsequent thereto depending on a sequence.

Figure 4:
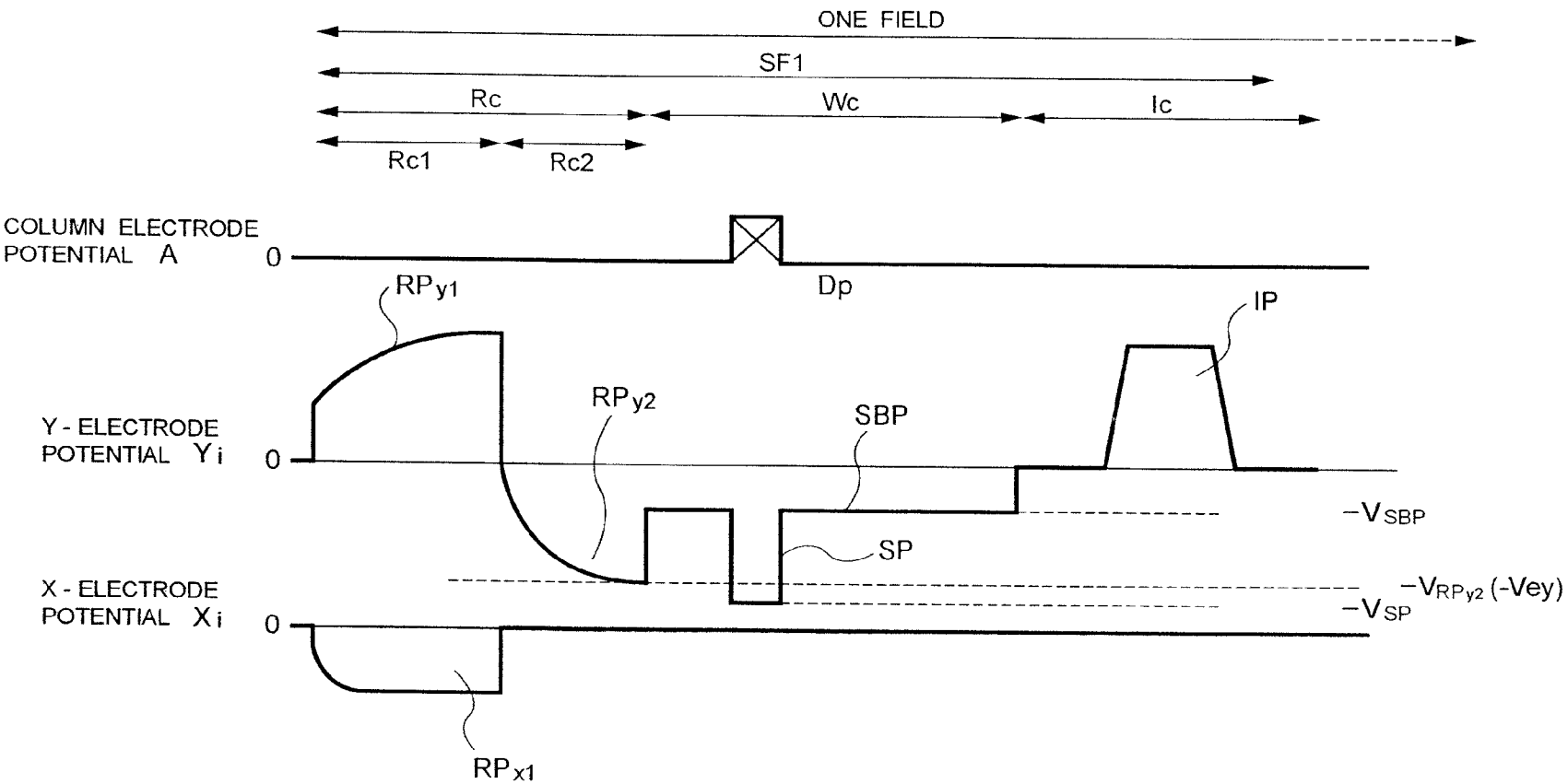
FIG. 4 is a diagram showing waveforms in a driving period in a first embodiment.

FIGS. 4-6 describe a display panel driving method in a first embodiment. Referring to FIG. 4 there are shown waveforms over a driving period in the first embodiment. The waveforms represent an example to which applied is a sequence comprised of a rest period Rc in which full screen write and full screen erasure are performed only in the starting sub-field SF1 of one filed, a selective write addressing period Wc, and a sustain period Ic.

First, a light emission load state of the plasma display panel is detected in accordance with a video signal one field before a current one (light emission load state detection stage). Detected as the light emission load state is the number of display cells which have been set to light emitting discharge cells among the display cells in the field one field before the current one.

Next, the Y-row electrode driver applies the Y-row electrodes with a reset pulse $RP_{y1}$ which has an amplitude voltage value increased toward a positive side over time in a former half Rc1 of a reset period Rc immediately before an addressing period Wc of the starting sub-field SF1 which forms part of one field of the video signal, while the X-row driver applies the X-row electrodes with a negative pulse $RP_{x2}$ to cause full screen write discharges between the X-row electrodes and Y-row electrodes to form wall charges in all cells (first stage).

Next, the Y-row electrode driver applies the Y-row electrodes with a wall charge adjusting pulse $RP_{y2}$ which has a negative polarity opposite to the reset pulse $RP_{y1}$, and has an amplitude voltage value increased toward a negative side over time to cause discharges between the X-row electrodes and Y-row electrodes in a latter half Rc2 of the reset period Rc. In this event, a target potential $-V_{RPy2}$ of the Y-row electrodes caused by the application of the wall charge adjusting pulse $RP_{y2}$ is adjusted in accordance with the light emission load state of the display panel (second stage). In this way, full screen erasure discharges occur between the X-row electrodes and Y-row electrodes to erase the formed wall charges.

Next, in the addressing period Wc, the Y-row electrode driver applies a scanning base pulse SBP to the Y-row electrodes to et the potential of the Y-row electrodes to $-V_{SBP}$. Next, in the sustain period Ic, the Y-row electrode driver applies a sustain pulse IP to the Y-row electrode to display an image.

Figures 5A, 5B:
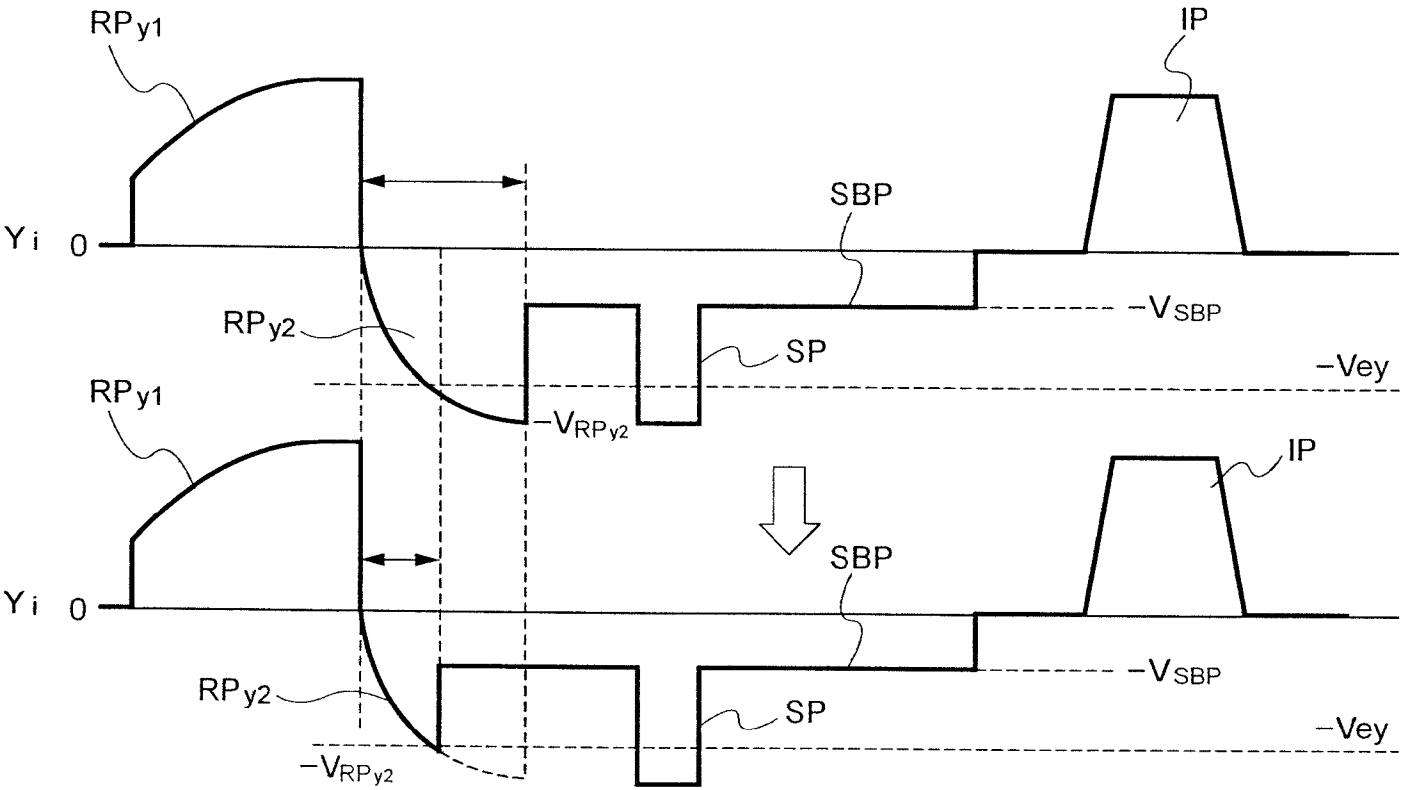
FIGS. 5A and 5B are diagrams showing waveforms when a light emission load amount is relatively large in the first embodiment.

Referring to FIGS. 5A and 5B, there are shown waveforms when the light emission load amount is relatively large. When the light emission load amount is relatively large, the target potential $-VRP_{y2}$ of the wall charge adjusting pulse $RP_{y2}$ is slightly larger than an optimal target potential $V_{ey}$, as shown in FIG. 5A. As a result, the wall charge is reduced in a slightly larger amount. Thus, by applying the wall charge adjusting pulse $RP_{y2}$ for a slightly shorter period, the target potential $-VRP_{y2}$ is adjusted to the optimal target potential $-V_{ey}$, and the amount of reduced wall charges is adjusted to an optimal value, as shown in FIG. 5B.

Here, a large light emission load amount refers to a large light emission load amount in the preceding field, such as a case where multiple display cells belonging to one displayed line are in a light emitting state. In such a state, when a negative pulse having a voltage increased over time is applied, discharges occur in multiple cells, resulting in a larger discharge current as a whole to cause distortions in waveforms. As a result, since target potential $-V_{RPy2}$ is lower than the optimal target potential $-V_{ey}$, the amount of reduced wall charges is insufficient. Accordingly, when there are a large number of light emission loads in the preceding field, the negative pulse is applied for a longer period to bring the target potential $-V_{RPy2}$ closer to the optimal target potential $-V_{ey}$. In this way, the wall charge amount is adjusted to an optimal value.

Figures 6A, 6B:
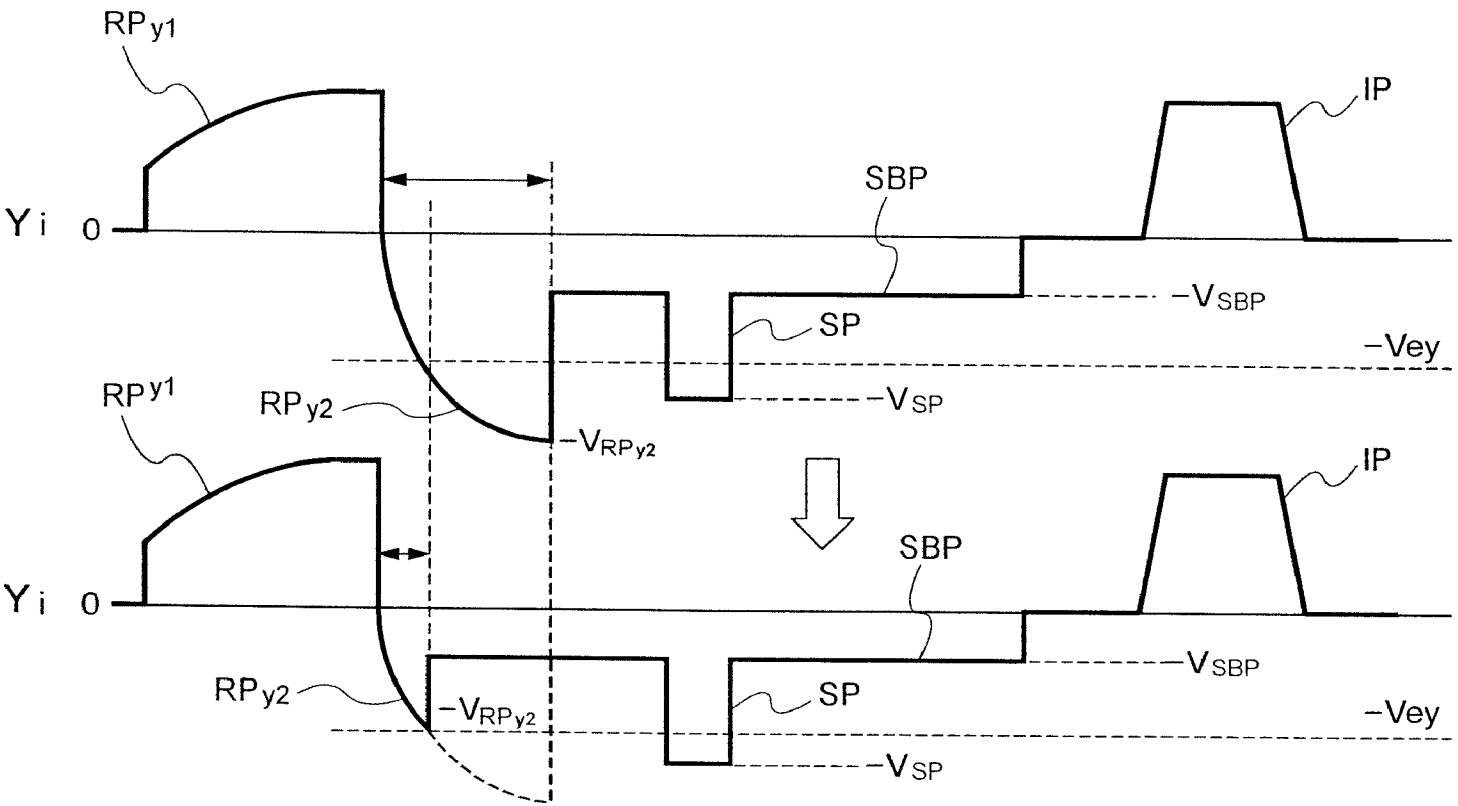
FIGS. 6A and 6B are diagrams showing waveforms when a light emission load amount is relatively small in the first embodiment.

Referring to FIGS. 6A and 6B, there are shown waveforms when the light emission load amount is relatively small. When the light emission load amount is relatively small, the target potential $-V_{RPy2}$ of the wall charge adjusting pulse $RP_{y2}$ is significantly higher than the optimal target potential −Vey, as shown in FIG. 5A. As a result, the wall charges are reduced in a significantly larger amount. Thus, by applying the wall charge adjusting pulse $RP_{y2}$ for an ever shorter period, adjust the target potential $V_{RPy2}$ is adjusted to the optimal target potential $-V_{ey}$, and the amount of reduced wall charges is adjusted to an optimal value, as shown in FIG. 6B.

Here, a smaller light emission load amount refers to a small number of light emission loads in the preceding field, such as a case where a small number of display cells belonging to one displayed line are in a light emitting state. In such an event, there are small number of display cells with a wall charge state in which there is a large potential difference between the column electrode and row electrode Y. As a negative pulse having an applied voltage increased over time is applied in such a state, discharges occur in a small number of cells. In this event, a discharge current is relatively small, and waveform distortions are also small. As a result, since the target potential $-V_{RPy2}$ becomes larger as compared with the optimal target potential $-V_{ey}$, the wall charges are reduced in an excessive amount. Accordingly, when there is a small number of light emission loads in the preceding field, a pulse of a first polarity is applied for a shorter period to bring the target potential $V_{RPy2}$ closer to the optimal target potential $-V_{ey}$. In this way, the wall charge amount is adjusted to an optimal value.

As described above, while the target potential $-V_{RPy2}$ of the negative wall charge adjusting pulse $RP_{y2}$ varies depending on the light emission load, the light emission load state is detected to conduct control to adjust a time for which the wall charge adjusting pulse $RP_{y2}$ is applied in accordance with the detected light emission load state such that the target potential $-V_{RPy2}$ reaches the optimal target potential $-V_{ey}$.

Figure 7:
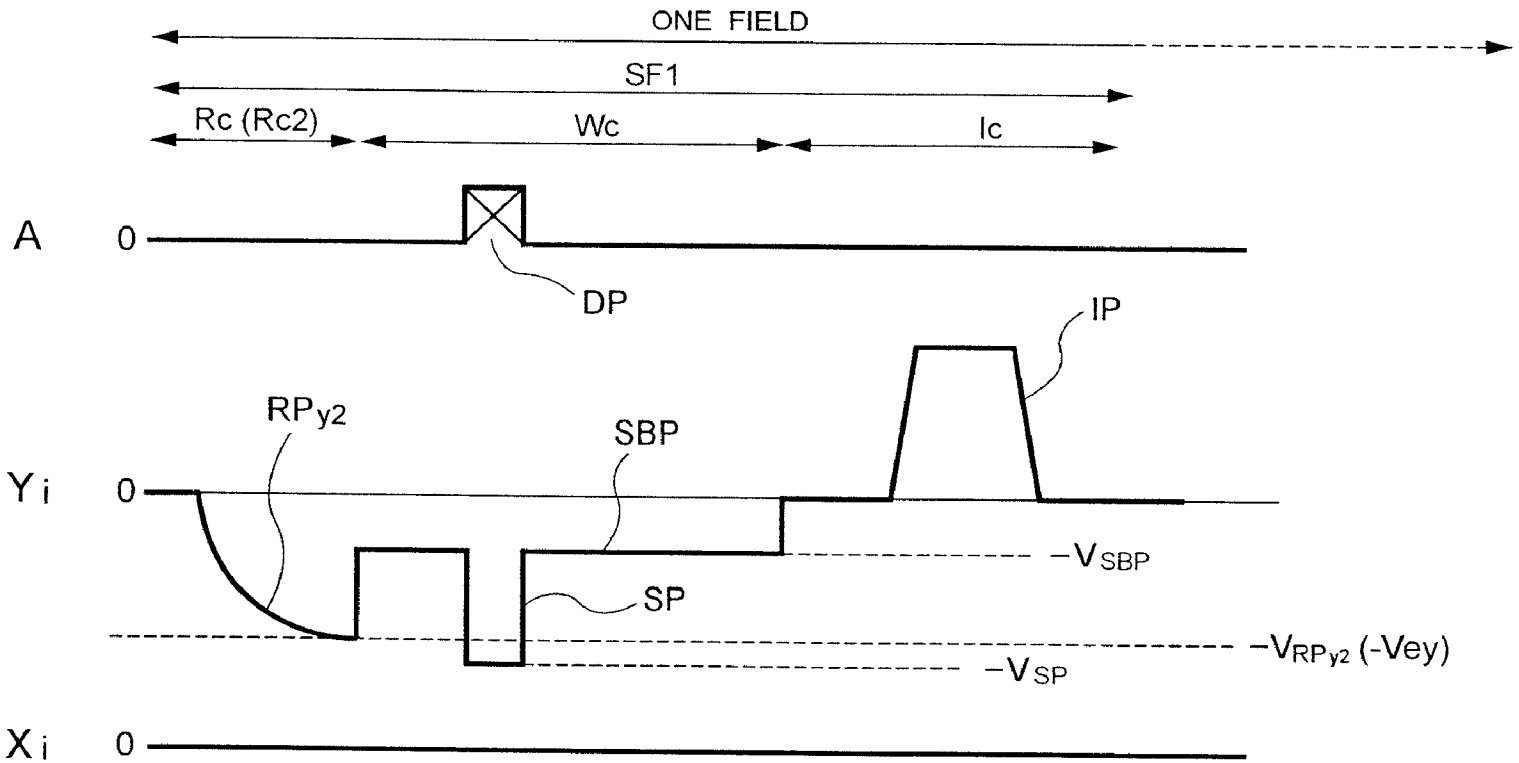
FIG. 7 is a diagram showing waveforms in a driving period in a second embodiment.

FIGS. 7-9 describe a display panel driving method according to a second embodiment. Referring to FIG. 7, there are shown waveforms over a driving period in the second embodiment. Here, the waveforms represent an example to which applied is a sequence comprised of a rest period Rc, a selective write addressing period Wc, and a sustain period Ic for the starting substrate SF1 of one field, and an example to which applied is a sequence in which the full screen write period is eliminated from the sequence in the first embodiment.

First, a light emission load state of the plasma display panel is detected in accordance with a video signal one field before a current one (light emission load state detection stage). Detected as the light emission load state is the number of display cells which have been set to light emitting discharge cells among the display cells in the field one field before the current one.

Next, the Y-row electrode driver applies the Y-row electrodes with a reset pulse $RP_{y2}$ which has an amplitude voltage value increased over time in a reset period Rc immediately before an addressing period Wc of the starting sub-field SF1 which forms part of one field of the video signal to cause discharges between the X-row electrodes and Y-row electrode. In this event, a target potential $-V_{RPy2}$ of the Y-row electrodes caused by the application of the wall charge adjusting pulse $RP_{y2}$ is adjusted in accordance with the light emission load state of the display panel (second stage).

Next, in the addressing period Wc, the Y-row electrode driver applies a scanning base pulse SBP to the Y-row electrodes to set the potential of the Y-row electrodes to $-V_{SBP}$. Next, a scanning pulse SP is applied to the Y-row electrodes in accordance with pixel data pulses applied to the column electrodes to set the potential of the Y-row electrodes to $-V_{SP}$. Next, in the sustain period Ic, the Y-row electrode driver applies a sustain pulse IP to the Y-row electrodes to display an image.

Figures 8A, 8B:
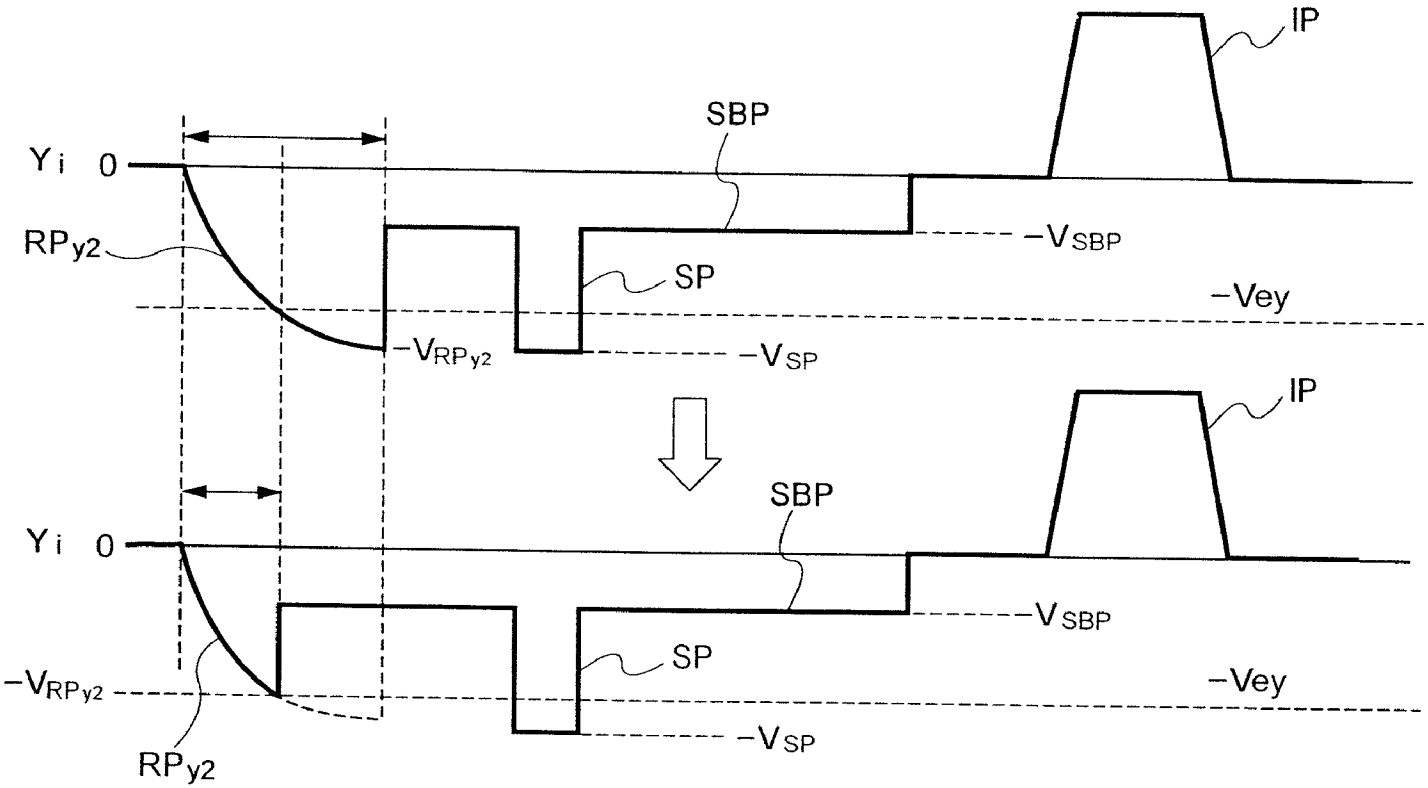
FIGS. 8A and 8B are diagrams showing waveforms when a light emission load amount is relatively large in the second embodiment.

Referring to FIGS. 8A and 8B, there are shown waveforms when the light emission load amount is relatively large. When the light emission load amount is relatively large, the target potential $-VRP_{y2}$ is slightly larger than an optimal target potential $V_{ey}$, as shown in FIG. 8A. As a result, the wall charge is reduced in a slightly larger amount. Thus, by applying the wall charge adjusting pulse $RP_{y2}$ for a slightly shorter period, the target potential $-V_{RPy2}$ is adjusted to the optimal target potential $-V_{ey}$, and the amount of reduced wall charges is adjusted to an optimal value, as shown in FIG. 8B.

Figures 9A, 9B:
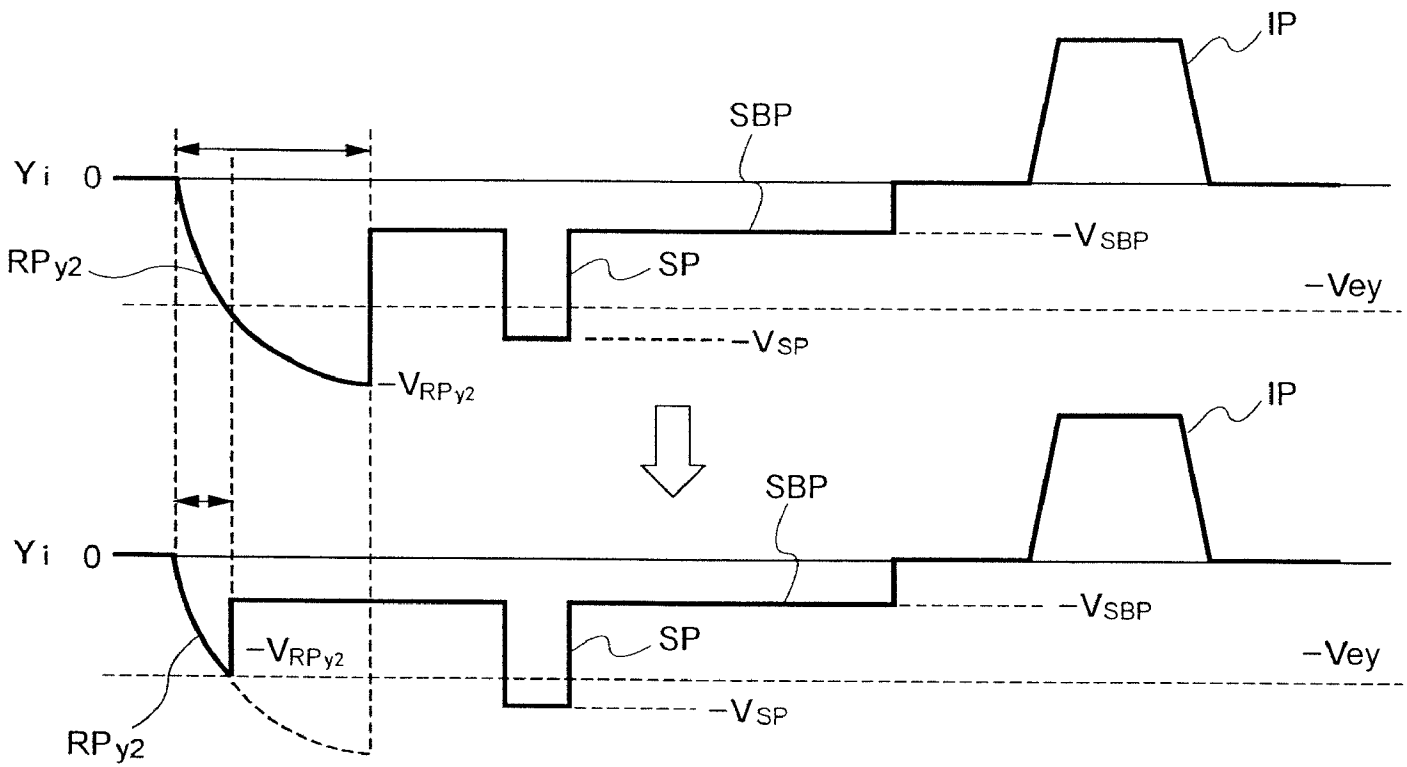
FIGS. 9A and 9B are diagrams showing waveforms when a light emission load amount is relatively small in the second embodiment.

Referring to FIGS. 9A and 9B, there are shown waveforms when the light emission load amount is relatively small. When the light emission load amount is relatively small, the target potential $-V_{RPy2}$ of the wall charge adjusting pulse $RP_{y2}$ is significantly higher than the optimal target potential −Vey, as shown in FIG. 9A. As a result, the wall charges are reduced in a significantly larger amount. Thus, by applying the wall charge adjusting pulse $RP_{y2}$ for an ever shorter period, adjust the target potential $V_{RPy2}$ is adjusted to the optimal target potential $-V_{ey}$, and the amount of reduced wall charges is adjusted to an optimal value, as shown in FIG. 9B.

Figure 10:
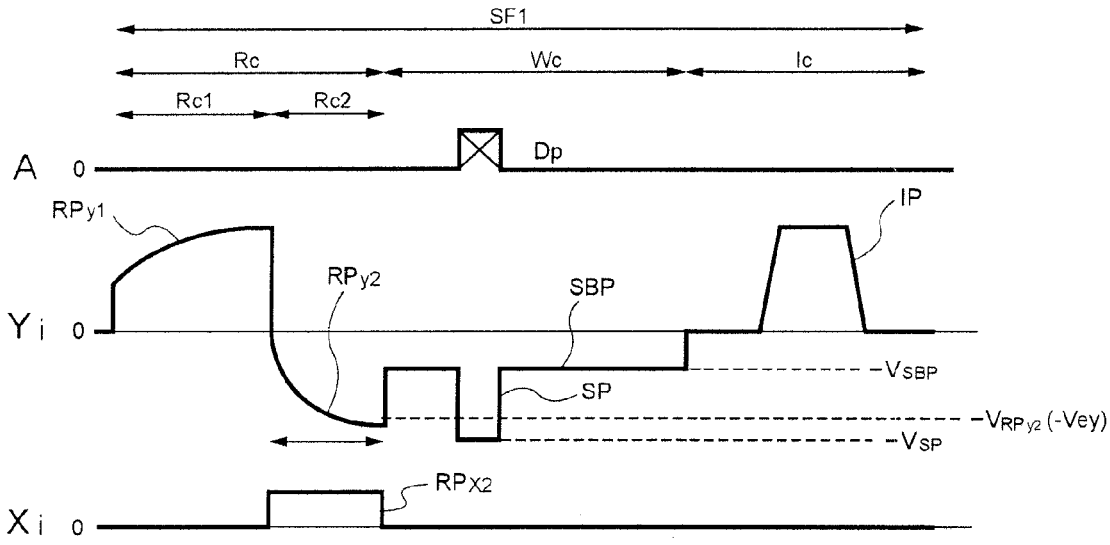
FIG. 10 is a diagram showing waveforms in a driving period in a third embodiment.
Figure 11:
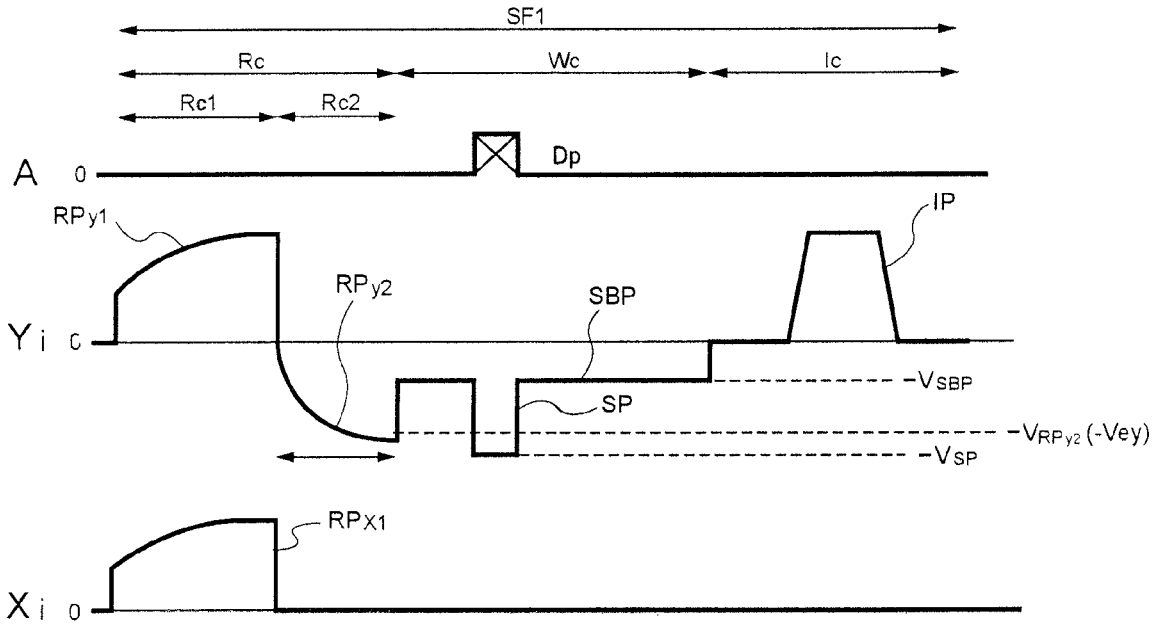
FIG. 11 is a diagram showing other waveforms in the driving period in the third embodiment.

FIGS. 10 and 11 describe a display panel driving method in a third embodiment.

Referring to FIG. 10, there is shown a configuration in which the row electrodes X are applied with a positive pulse $RP_{x2}$ for a period in which the row electrodes Y are applied with a negative pulse $RP_{y2}$ which has an amplitude voltage value increased over time to reach a predetermined target potential in the configuration of the first embodiment which comprises a sequence comprised of a reset period Rc in which full screen write and full screen erasure are performed only in the starting sub-field SF1 of one filed, a selective write addressing period Wc, and a sustain period Ic.

First, a light emission load state of the plasma display panel is detected in accordance with a video signal one field before a current one (light emission load state detection stage). Detected as the light emission load state is the number of display cells which have been set to light emitting discharge cells among the display cells in the field one field before the current one.

Next, the Y-row electrode driver applies the Y-row electrodes with a reset pulse $RP_{y1}$ which has an amplitude voltage value increased toward a positive side over time in a former half Rc1 of a reset period Rc immediately before an addressing period Wc of the starting sub-field SF1 which forms part of one field of the video signal, to cause full screen write discharges between the X-row electrodes and Y-row electrodes to form wall charges in all cells (first stage).

Next, the Y-row electrode driver applies the Y-row electrodes with a wall charge adjusting pulse $RP_{y2}$ which has a negative polarity opposite to the reset pulse $RP_{y1}$, and has an amplitude voltage value increased toward a negative side over time to cause discharges between the X-row electrodes and Y-row electrodes in a latter half Rc2 of the reset period Rc. In this event, a target potential $-V_{RPy2}$ of the Y-row electrodes caused by the application of the wall charge adjusting pulse $RP_{y2}$ is adjusted in accordance with the light emission load state of the display panel, while the X-row electrodes are applied with a negative pulse $RP_{x2}$ in parallel.

In this way, full screen erasure discharges occur between the X-row electrodes and Y-row electrodes to erase the formed wall charges. Next, in the addressing period Wc, the Y-row electrode driver applies a scanning pulse SP to the Y-row electrodes. The scanning pulse SP is applied to the Y-electrodes in accordance with the image data pulses applied to the column electrodes. Next, in the sustain period Ic, the Y-row electrode driver applies a sustain pulse IP to the Y-row electrode to display an image.

Referring to FIG. 11, there is shown a configuration in which in which the row electrodes X are applied with a positive pulse $RP_{x1}$ for a period in which the row electrodes Y are applied with a positive pulse $RP_{y1}$ which has an amplitude voltage value increased over time to reach a predetermined target potential in the configuration of the first embodiment which comprises a sequence comprised of a reset period Rc in which full screen write and full screen erasure are performed only in the starting sub-field SF1 of one filed, a selective write addressing period Wc, and a sustain period Ic.

First, a light emission load state of the plasma display panel is detected in accordance with a video signal one field before a current one (light emission load state detection stage). Detected as the light emission load state is the number of display cells which have been set to light emitting discharge cells among the display cells in the field one field before the current one.

Next, the Y-row electrode driver applies the Y-row electrodes with a reset pulse $RP_{y1}$ which has an amplitude voltage value increased toward the positive side over time in a former half Rc1 of a reset period Rc immediately before an addressing period Wc of the starting sub-field SF1 which forms part of one field of the video signal, while the X-row electrode driver applies the positive pulse $RP_{x1}$ to the row electrodes X. In this way, full screen write discharges are caused between A-row electrodes and Y-row electrodes (opposite discharges) to form wall charges in all cells (first stage).

Next, the Y-row electrode driver applies the Y-row electrodes with a wall charge adjusting pulse $RP_{y2}$ which has a negative polarity opposite to the reset pulse $RP_{y1}$, and has an amplitude voltage value increased toward the negative side over time to cause discharges between the X-row electrodes and Y-row electrodes in a latter half Rc2 of the reset period Rc. In this event, a target potential $-V_{RPy2}$ of the Y-row electrodes caused by the application of the wall charge adjusting pulse $RP_{y2}$ is adjusted in accordance with the light emission load state of the display panel.

In this way, full screen erasure discharges occur between the X-row electrodes and Y-row electrodes to erase the formed wall charges. Next, in the addressing period Wc, the Y-row electrode driver applies a scanning pulse SP to the Y-row electrodes. The scanning pulse SP is applied to the Y-electrodes in accordance with the image data pulses applied to the column electrodes. Next, in the sustain period Ic, a sustain pulse IP is applied to display an image.

As shown in the foregoing FIGS. 10 and 11, even when the X-row electrodes are applied with different waveforms, similar advantages can be provided to the first embodiment by adjusting the target potential of the negative pulse which is applied immediately before the addressing period and has an applied voltage value increased over time to reach a predetermined target potential in accordance with the light emission load state in the preceding field.

As is apparent from a plurality of foregoing embodiments, by applying the display panel driving method according to the present invention, it is possible to avoid an erroneous discharge which is likely to occur in the addressing field Wc for selective discharge.

This application is based on Japanese Patent Application No. 2006-157502 which is hereby incorporated by reference.

What is claimed is:

1. A method of driving a plasma display panel which has a plurality of row electrode pairs each comprised of a first row electrode and a second row electrode which form a pair, a plurality of column electrodes arranged across said row electrode pairs, and display cells formed at respective intersections of said row electrode pairs and said column electrode, wherein a display period for one field of a video signal is comprised of a plurality of sub-fields, a reset period is provided prior to an addressing period of a starting sub-field in the display period for one field to make a display at multiple levels, and a scan pulse is in turn applied to the first row electrodes of the row electrode pairs in said addressing period, said method comprising:

a light emission load state detection stage for detecting a light emission load state of the plasma display panel in accordance with the video signal in the preceding field; and a first stage in the reset period for applying the first row electrodes with a pulse of a first polarity which has an applied voltage value increased over time to reach a predetermined target potential which is higher than a peak potential of said scan pulse, wherein said first stage includes a stage for controlling the target potential of the first polarity pulse in accordance with the light emission load state, wherein said stage of controlling the target potential of the first polarity pulse includes a stage for extending the time length for which the pulse of the first polarity is applied when the light emission load state presents a large number of light emission loads as compared with a predetermined value, and shortening the time length for which the pulse of the first polarity is applied when the light emission load state presents a small number of light emission loads as compared with the predetermined value.

2. A method of driving a plasma display panel according to claim 1, further comprising, prior to said first stage, a second stage in the reset period for applying the first row electrodes with a pulse of a second polarity opposite to the first polarity, which has an applied voltage value increased over time.

3. A method of driving a plasma display panel according to claim 1, further including a stage for applying said first row electrodes with a scanning pulse including a selected potential of the first polarity superposed on a non-selected potential of the first polarity, and applying the column electrodes with pixel data pulses in accordance with the video signal.

4. A method of driving a plasma display panel according to claim 3, wherein said pulse of the first polarity reaches the predetermined target potential between the selected potential and the non-selected potential of said first row electrodes in the addressing period.

5. A method of driving a plasma display panel according to claim 1, wherein said light emission load state detection stage senses the light emission load state from luminance levels and a luminance distribution of a luminance histogram obtained from the video signal.

6. A method of driving a plasma display panel according to claim 1, wherein said light emission load state detection stage senses the light emission load state from an average luminance level of the video signal.

* * * * *